US005492164A

United States Patent [19]

Gist

[11] Patent Number: 5,492,164

[45] Date of Patent: Feb. 20, 1996

[54] WINDOW SAFETY SYSTEM FOR A CHILD OR THE LIKE

[76] Inventor: Lanny J. Gist, 203 N. Main, Bowling Green, Ohio 43402

[21] Appl. No.: 264,665

[22] Filed: Jun. 23, 1994

[51] Int. Cl.[6] ..... E06B 3/32

[52] U.S. Cl. ..... 160/102; 49/54; 49/65

[58] Field of Search ..... 160/102, 201, 160/264, 274; 49/50, 54, 55, 65

[56] References Cited

U.S. PATENT DOCUMENTS

| | | | |
|---|---|---|---|
| Re. 17,978 | 2/1931 | McWane . | |
| 334,881 | 1/1886 | McLean | 160/102 |
| 407,072 | 7/1889 | Horton . | |
| 498,916 | 6/1893 | Meyer . | |
| 807,276 | 12/1905 | Johnston . | |
| 993,654 | 5/1911 | Conant | 160/102 |
| 1,174,664 | 3/1916 | Braune . | |
| 1,279,590 | 9/1918 | Roe . | |
| 1,618,224 | 2/1927 | Porras . | |
| 1,634,843 | 7/1927 | McWane . | |
| 1,638,724 | 8/1927 | Bowles . | |
| 1,693,853 | 12/1928 | McWane . | |
| 1,726,188 | 8/1929 | Martin . | |
| 1,999,421 | 4/1935 | Petris . | |
| 2,276,177 | 3/1942 | Flugger | 160/102 |
| 2,314,230 | 3/1943 | Lunken . | |
| 2,355,170 | 8/1944 | Lunken . | |
| 2,450,349 | 9/1948 | Mayer | 160/102 X |
| 2,772,452 | 12/1956 | Modes . | |
| 2,829,712 | 4/1958 | Quinn . | |
| 4,325,203 | 4/1982 | Wicks . | |
| 4,671,012 | 6/1987 | Merklinger | 49/55 |
| 5,050,923 | 9/1991 | Petelka | 160/264 X |

FOREIGN PATENT DOCUMENTS

| | | | |
|---|---|---|---|
| 264999 | 2/1927 | United Kingdom | 160/274 |

*Primary Examiner*—Blair M. Johnson

*Attorney, Agent, or Firm*—Bradford E. Kile; Ruffin B. Cordell; Michael J. McKeon

[57] ABSTRACT

A window safety system having a first and second vertical track installed as mirror images on opposite sides of a window frame. The system utilizes at least one elongate blocking element which extends across the window width and is secured to opposing guide elements which smoothly travel within the vertical tracks. A system cover is engaged at opposite ends to the vertical tracks to travel with lower window sash. The guide elements which are connected in series to one another by a flexible belt within the vertical tracks. The system cover interacts with a lower rail of a window sash such that when the window sash is raised to an open position, the system cover travels with the lower sash. This travel in turn causes the guide elements to translate within the vertical tracks and guiding blocking rods to a position laterally across the opening of the window. The blocking rods thereby prevent egress of a child or the like through the open window. When the window is closed a reverse sequence occurs and the blocking rods are nested beneath the cover upon the window sill.

33 Claims, 11 Drawing Sheets

WINDOW SAFETY SYSTEM FOR A CHILD OR THE LIKE

BACKGROUND OF THE INVENTION

The present invention relates to a window safety system for use in standard windows having upper and lower window sashes. More specifically, the invention is directed to an improved window safety system which interacts with a lower window sash such that as the lower window sash is raised, the safety system automatically places at least one blocking element across the window opening to operably prevent a small child, mentally impaired adult, pet or the like from falling through the open window.

Opening windows to obtain fresh ambient air is appealing and pleasurable in warm weather seasons. In multi-story homes and buildings, however, open windows can be problematic and present a potential safety hazard. In this, an open window is an inescapable attraction to a child, a mentally impaired adult or a pet who approaches the window opening to gaze outside. Disaster may strike if the child climbs onto an open window sill or even leans out a window to look down. Any fall is almost certain to result in death or serious bodily injury. Moreover, the emotional trauma to a parent attendant such a tragedy is debilitating.

The dangers associated with an open window has lead to a number of proposed solutions. Many residential apartment buildings have converted to sealed windows having a small vent which may be opened to allow fresh air to enter the living space. The obvious disadvantages associated with these window systems is that the window can not be opened at all.

Other prior art safety systems utilize a permanently installed bar cover which is screwed into the frame of the window. This system has several disadvantages. First, it is very unattractive to have permanently installed bars covering a window opening. Second, the fastening elements which are needed to secure a bar cover to a window frame Bay cause extensive damage to the frame. Third, these permanent create a prison atmosphere and block any egress which may be necessary in the event of a fire or other emergency.

Another prior art attempt utilizes a plurality of telescopic rods or collapsible scissor bars which have one end secured to the window sill and the other end secured to a window sash such that when the window sash is raised to an open position, the rods or bars extend and cover the window opening. This system has several recognized disadvantages. First, the presence of the rods is obvious whether the window is open or closed which detracts from the aesthetic appearance of the window. Second, the telescopic rods are an expensive addition to the window system. Third, the system must be screwed into the window sash and sill which causes permanent damage to the window and surrounding frame.

Another prior art attempt utilizes a plurality of bars which are secured to the underside of the lower rail of a lower window sash. When the lower window sash is in a closed position, the bars are housed beneath the window sill in an adjacent wall. As the lower window sash is raised the bars are raised into the window opening thereby providing a safety feature. Several disadvantages are recognized. First, this system involves major alterations to the window system and surrounding walls in order to house the bars. Second, the system is a costly alternative to prior art safety systems.

Third, the system causes permanent damage to the window sash and frame.

Yet another prior art attempt utilizes a bar system which travels in vertical guides secured to the window frame such that as the window is opened the bars occupy the opening. This prior art attempt utilizes a plurality of runners which guide an attached bar. This complex system has several recognized limitations. First, the system utilizes complex parts which increases the difficulty of installation and increases the production cost. Second, the system does not provide a means for housing the bars when the window is in a closed position. Third, the system provides no easy and convenient way to disengage the safety system when not needed. Fourth, the system requires major alterations to an existing window structure.

The difficulties and limitations suggested in the preceding are not intended to be exhaustive, but rather are among many which demonstrate that although significant attention has been devoted to window safety systems, such systems appearing in the past will admit to worthwhile improvement.

OBJECTS AND BRIEF SUMMARY OF THE INVENTION

It is therefore a general object of the invention to provide a novel window safety system which will obviate or minimize difficulties of the type previously described.

It is another general object of the invention to provide a novel window safety system which will effectively block accidental egress by a child, mentally impaired adult, pet or the like from an open window.

It is a specific object of the invention to provide a window safety system which may be easily installed in existing windows without the need for permanent defacing of the window structures.

It is another specific object of the invention to provide a window safety system which may be easily installed in existing windows of a variety of different designs and dimensions.

It is another object of the invention to provide a window safety system which operates automatically when a lower window sash is raised to open the window.

It is still another object of the invention to provide a window safety system which does not detract from the aesthetic appearance of the window and which can not be observed when the lower window sash is in a closed position.

It is yet another object of the invention to provide a window safety system which contains few parts and may be manufactured at an economical cost per unit.

It is still yet another object of the invention to provide a window safety system which may be securely installed in a window structure and provides safe and reliable protection against accidental falling through an open window.

It is yet another object of the invention to provide a window safety system which may be quickly and easily deactivated by an adult in an emergency to free the window opening and allow egress.

BRIEF SUMMARY OF A PREFERRED EMBODIMENT OF THE INVENTION

A preferred embodiment of the invention which is intended to accomplish the foregoing objects includes a window safety system having a first and second vertical track installed as mirror images on opposite sides of a window frame. The system utilizes at least one elongate blocking element which extends across the window width and is secured to opposing guide elements which smoothly travel within the vertical tracks. A system cover is engaged at opposite ends to the vertical tracks to travel with lower window sash. The guide elements which are connected in series to one another by a flexible belt within the vertical tracks. The system cover interacts with a lower rail of a window sash such that when the window sash is raised to an open position, the system cover travels with the lower sash. This travel in turn causes the guide elements to translate within the vertical tracks and guiding blocking rods to a position laterally across the opening of the window. The blocking rods thereby prevent egress of a child or the like through the open window. When the window is closed a reverse sequence occurs and the blocking rods are nested beneath the cover upon the window sill.

DRAWINGS

Other objects and advantages of the present invention will become apparent from the following detailed description of a preferred embodiment thereof taken in conjunction with the accompanying drawings, wherein.

Figure 6A:
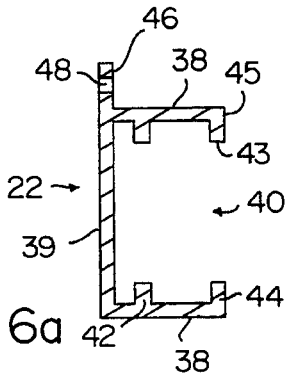

FIG. 6*a* is a cross-sectional view of a vertical track of the window safety system of the preferred embodiment of the present invention.

Figure 6B:
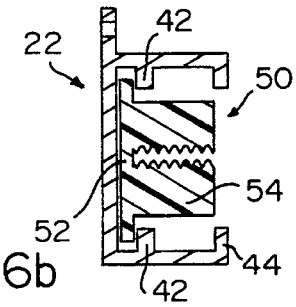
Figure 7A:
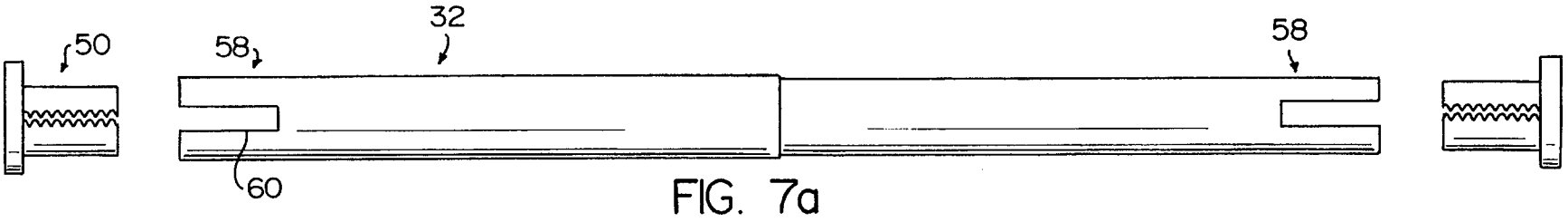
Figure 7B:
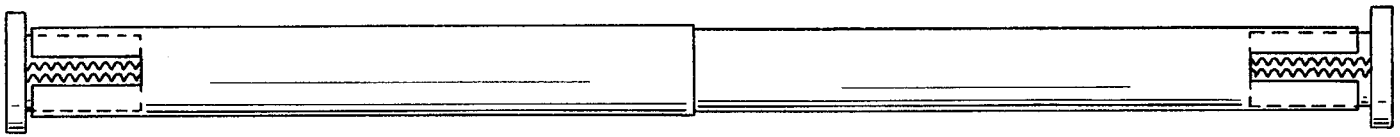

FIG. 6*b* is a cross-sectional view of a vertical track with a guiding element received therein of the window safety system of the preferred embodiment of the present invention, FIG. 7*a* is a plan view of the guide element and blocking element of the preferred embodiment of the window safety system of the present invention, FIG. 7*b* is a plan view of the guide element inserted into a distal end of the blocking element of the preferred embodiment of the window safety system of the present invention.

Figure 7C:
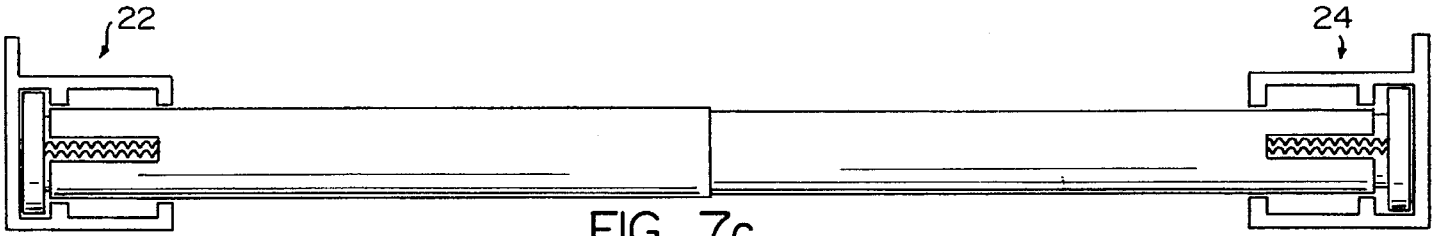
Figure 8B:
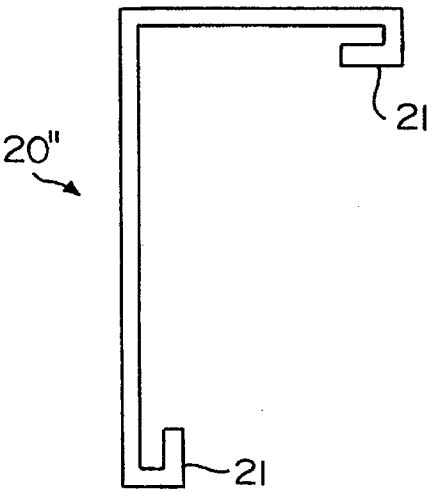
Figure 8A:
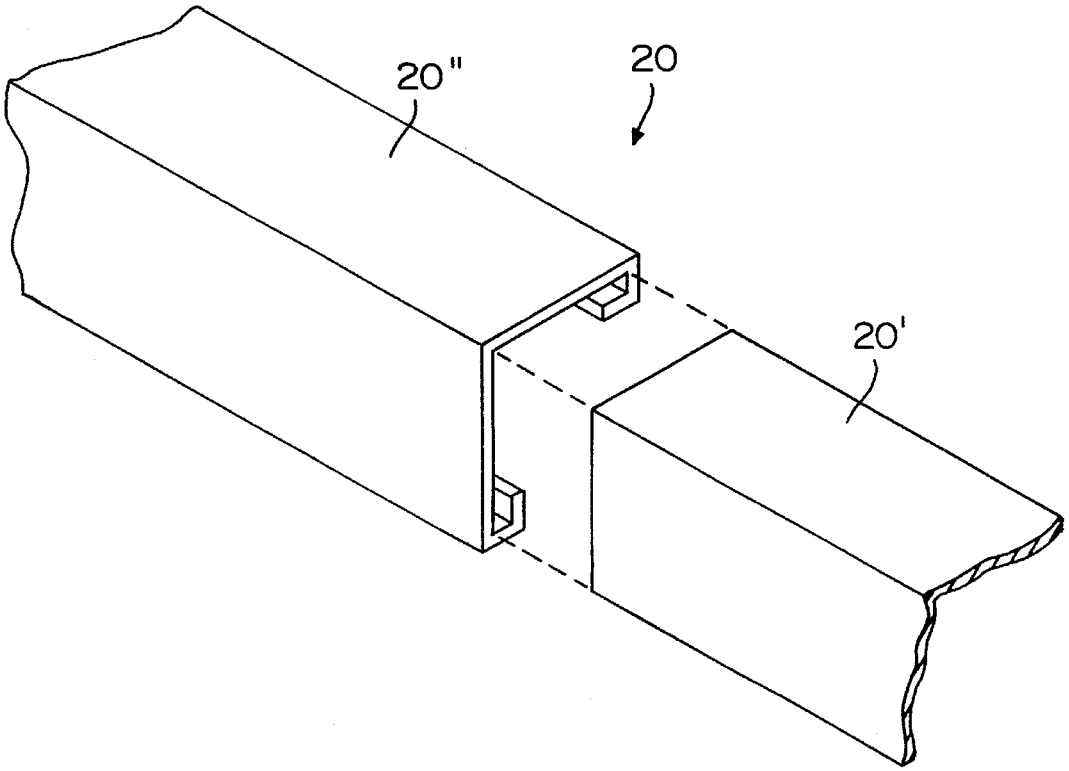

FIG. 7*c* is a plan view of the guide element inserted into a distal end of the blocking element as the assembly travels in the vertical track of the window safety system of the present invention, FIG. 8*a* is a schematic view of the telescopic system cover of the window safety system of the present invention.

Figure 9B:
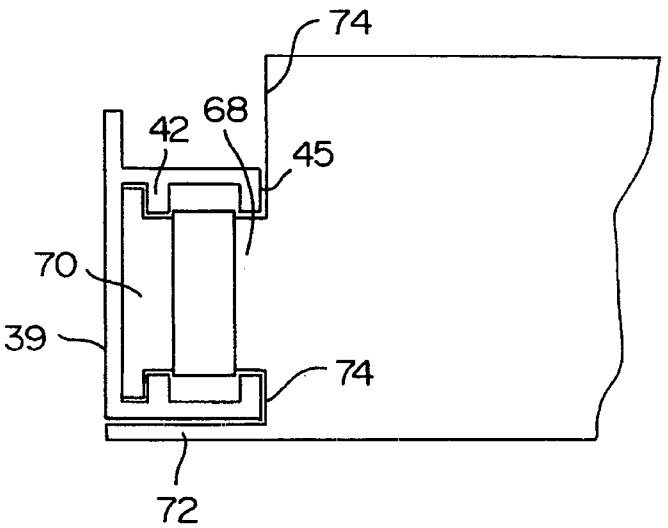
Figure 9A:
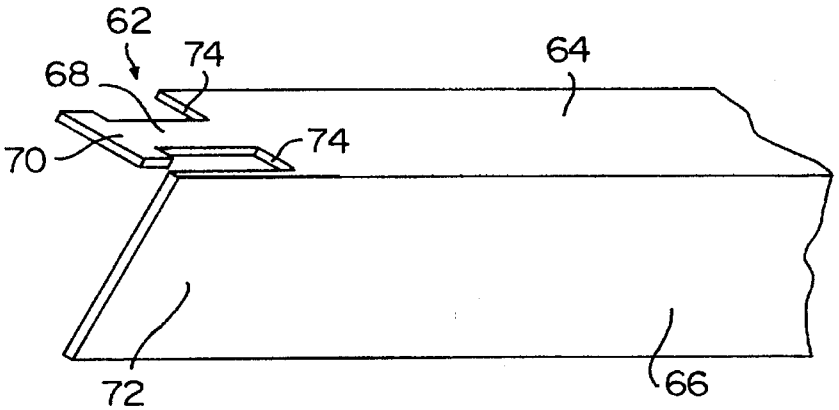

FIG. 8*b* is a cross-sectional view of the receiving element of telescopic system cover of the window safety system of the present invention, FIG. 9*a* is a schematic view of the distal end of the system cover of the window safety system of the present invention.

Figure 10:
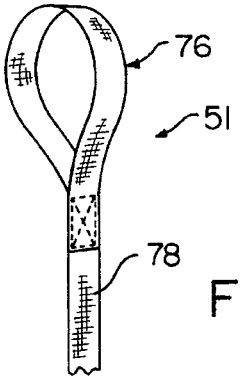

FIG. 9*b* is a schematic view of the distal end of the system cover received within the vertical track of the window safety system of the present invention, FIG. 10 is a schematic view of the connecting belt of the window safety system of the present invention.

Figure 11A:
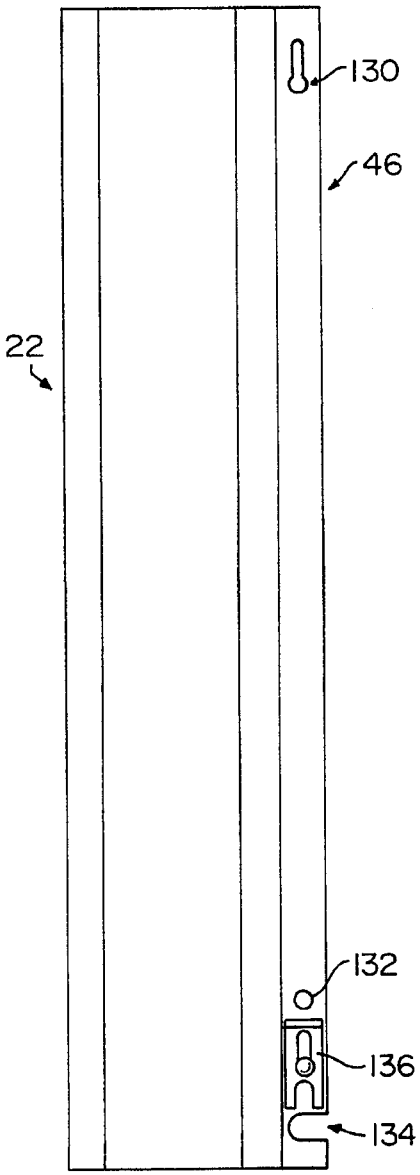

FIG. 11*a* and a front and a cross-sectional view respectively of the vertical track with attachment extension of the window safety system of the present invention.

Figure 12:
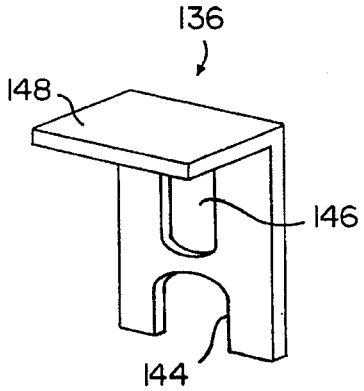

FIG. 12 is an isometric view of the slide lock bracket of the window safety system of the present invention.

Figure 13:
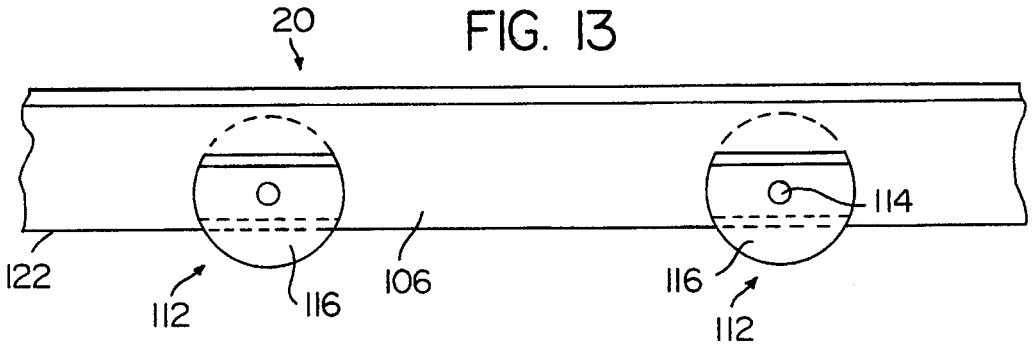

FIG. 13 is bottom view of the bar cover having secured connecting elements of an alternative embodiment of the win safety system the present invention.

Figure 14A:
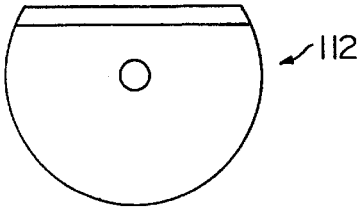
Figure 14B:
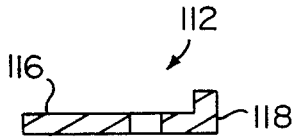

FIGS. 14*a* and 14*b* are plan and side views of the connecting dial of the window safety system of the present invention.

Figure 15:
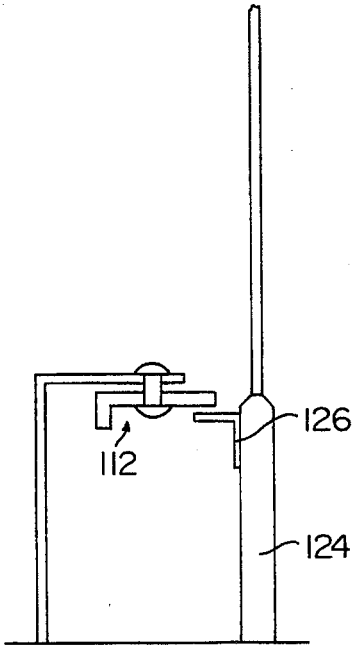

FIG. 15 is a schematic view of the bar cover with connecting dial interacting with a lower rail of the lower window sash of the window safety system of the present invention.

Figure 16:
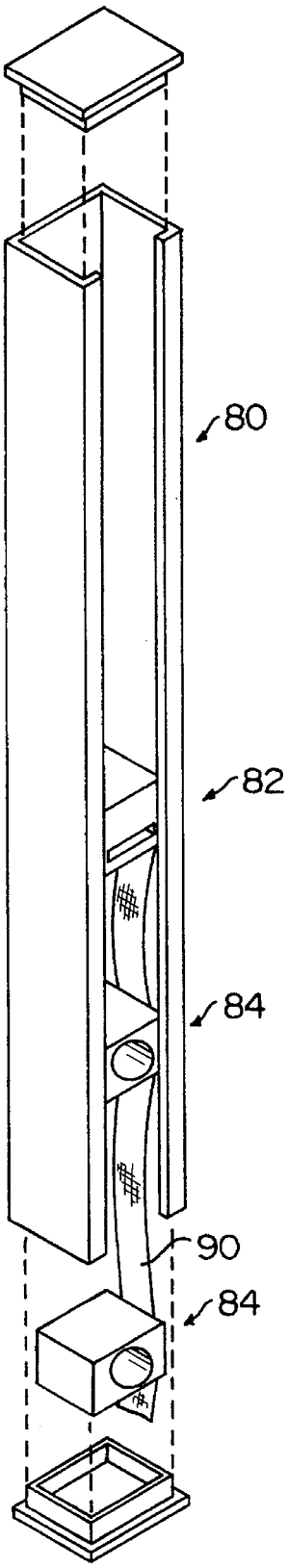

FIG. 16 is an exploded view of the track with received guide elements and guide bushing of an alternative embodiment of the window safety system of the present invention.

Figure 17A:
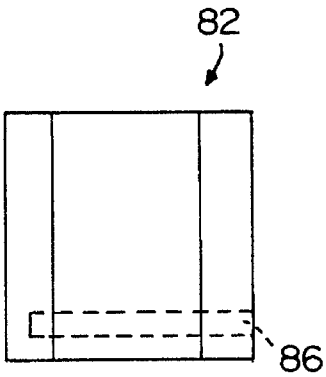
Figure 17B:
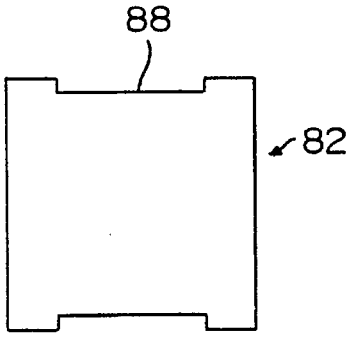
Figure 17C:
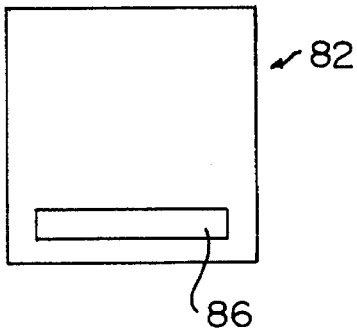

FIGS. 17*a* through 17*c* are elevation, plan, and front views of the guide busing of the window safety system of the present invention.

Figure 18:
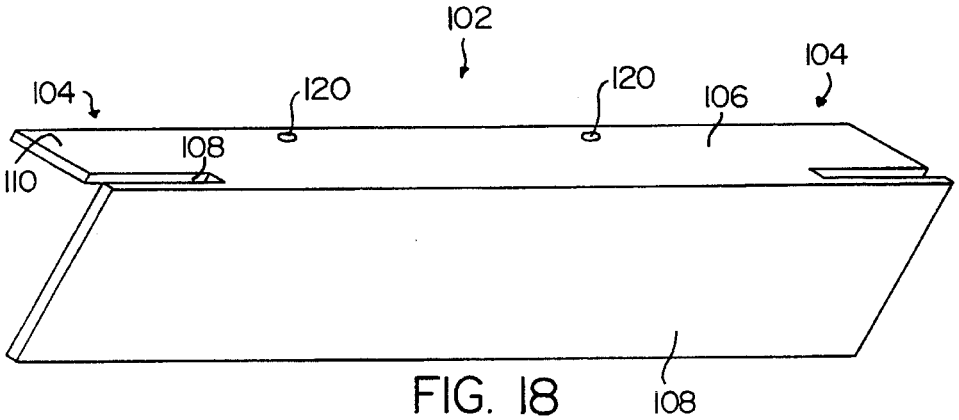

FIG. 18 is an isometric view of the bar cover of an alternative embodiment of the window safety system of the present invention.

Figure 19A:
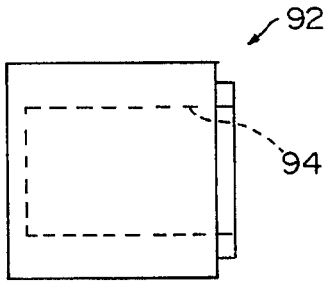
Figure 19B:
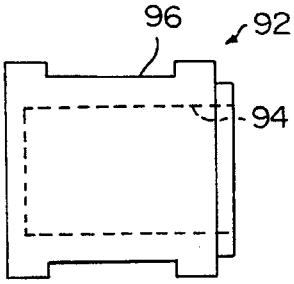
Figure 19C:
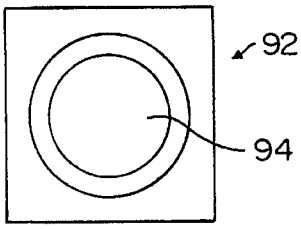

FIGS. 19*a* through 19*c* are elevation, plan, and front views an alternative guide element of the window safety system of the present invention.

Figure 20:
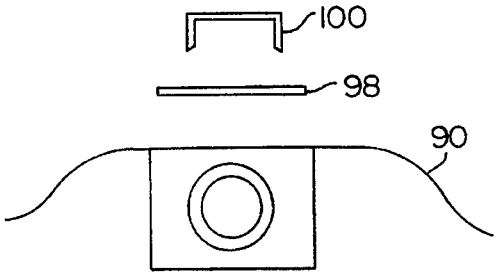

FIG. 20 is a front view of a belt being secured to a guide element of an alternative guide element of the window safety system of the present invention.

DETAILED DESCRIPTION

Context of the Invention

Figure 1:
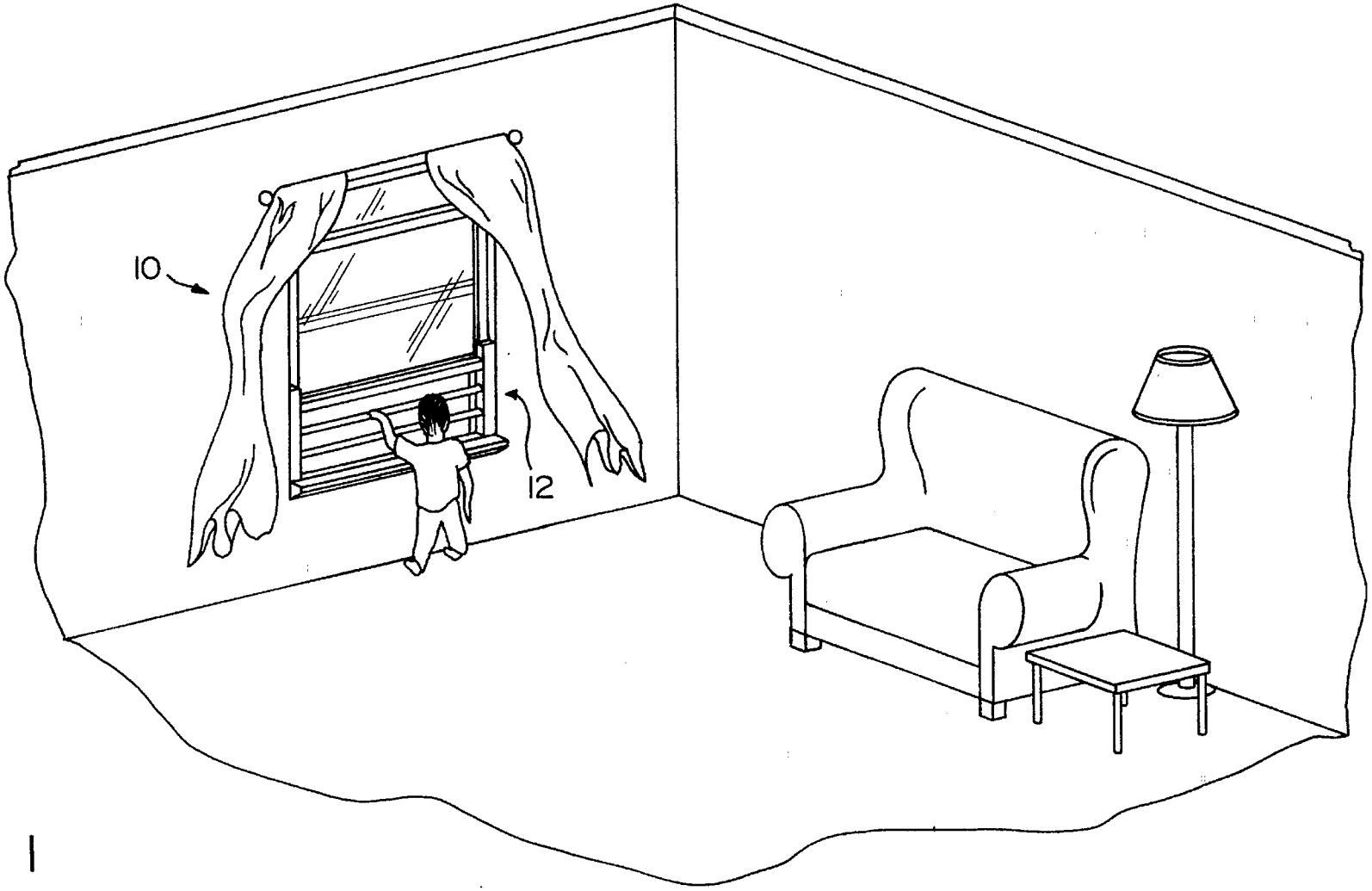
FIG. 1 is an axonometric view showing a living space having a window with the safety system of the present invention installed.

Referring now to the drawings and particularly to FIG. 1, there is shown a living space having a window 10 with the safety system 12 of the present invention installed. As schematically illustrated it is not unusual for a child to be drawn to an open window to look out and even attempt to lean out and/or climb up onto an open window sill. Once on the window sill tragedy is only a moment away. The subject invention is designed to effectively prevent such tragedy while affording all occupants the benefits of an open window environment.

Window Safety System

Figure 3:
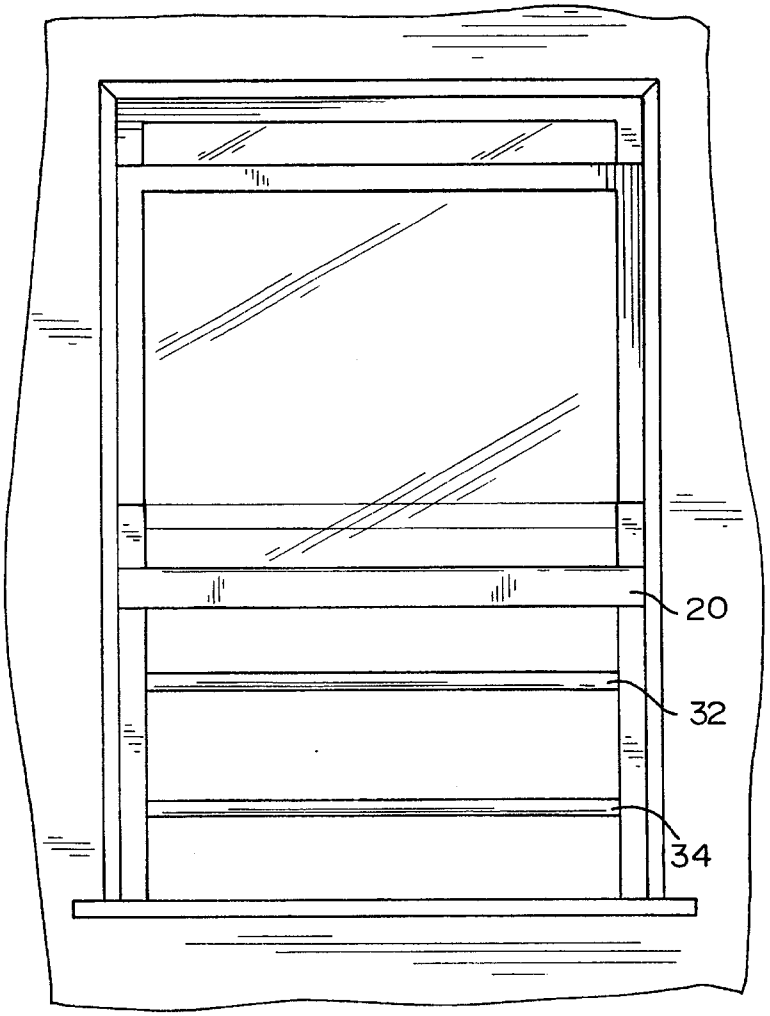
FIG. 3 is a front view of a window in an open position with the safety system of the present invention shown in an operative blocking position.
Figure 2:
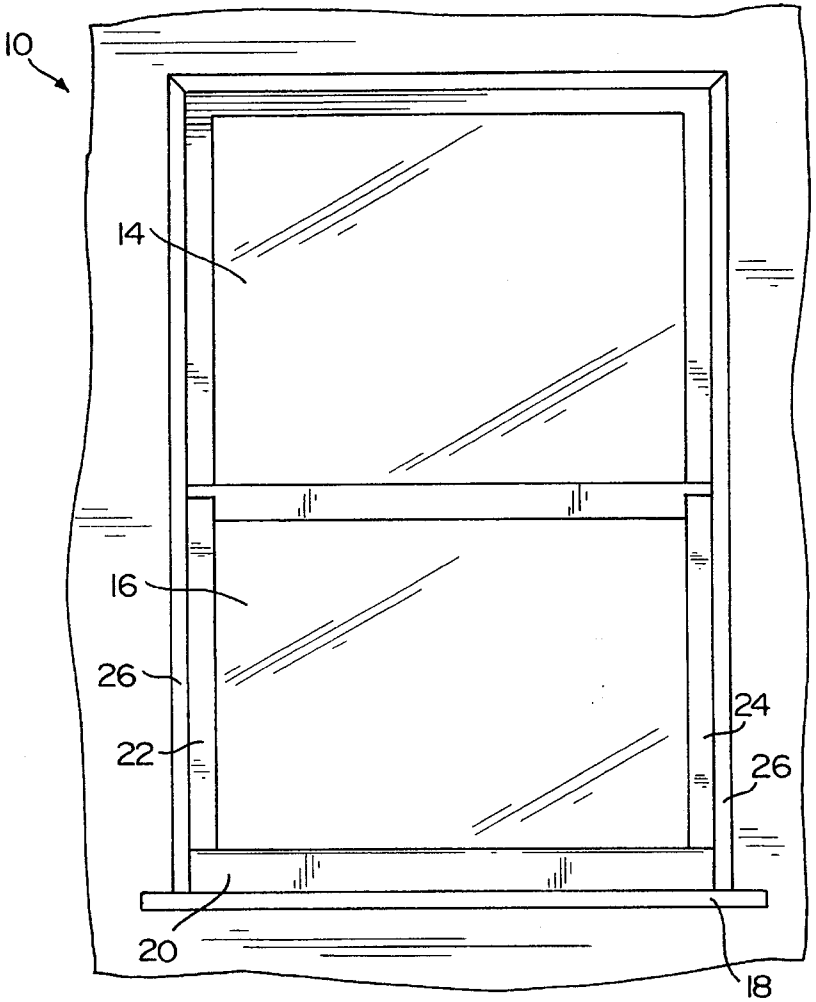
FIG. 2 is a front view of a window in a closed position with the safety system of the present invention installed.

FIG. 2 discloses a window 10 having an upper sash 14, lower sash 16, frame 26, and sill 18. The lower sash 16 of window 10 is in a lowered closed position as depicted in FIG. 2. In normal operation, when it is desired to open the window, the window user simply grasp a portion of the lower sash 16 and lifts upward until the desired amount of opening is achieved. The lower sash 16 of window 10 is in a raised open position as depicted in FIG. 3. A system cover 20 houses the components of the system when the window sash 16 is in a lowered closed position. This allows the window to remain aesthetically attractive even with the safety system 12 of the present invention installed. The safety system 12 includes a first elongate vertical track 22 and a second vertical elongate track 24 secured to opposing inner sides of frame 26 of the window 10. The tracks may be secured to the inner frames using conventional fasteners such as screws as described in more detail below. Only two screws are necessary to secure each track thereby reducing the permanent cosmetic affect of system installation.

The safety system includes a system cover 20. The system further includes blocking elements 32, 34. Preferably the blocking elements are tubular members having a first end which interacts with a guide element 50 of track 22 and a second end which interacts with an opposing guide element 50 of the opposing track 24. In the preferred embodiment, the blocking elements 32, 34 are of a telescopic design so as to enable easy installation of safety system 12 in a variety of window frame widths. The telescoping blocking elements 32, 34 utilize a conventional telescoping design wherein an outer tubular member receives an inner tubular member for relative longitudinal travel. Specifically, the blocking element 32 comprises a pair of fitted tubular members 32' 32" wherein member 32" receives member 32' and member 32' rides longitudinally along an inner circumferential surface of member 32". Similarly, the blocking element 34 comprises a pair of fitted tubular members 34' 34" wherein member 34" receives member 34' and member 34' rides longitudinally along an inner circumferential surface of member 34". The elements 32, 34 may alternatively be solid elongate cylindrical or rectangular members which similarly extend across the opening of the window when the window is opened. Moreover, any number of blocking elements may be utilized depending on the height of the window 10. In a preferred embodiment, two blocking elements 32, 34 are utilized to accommodate standard window heights to provide for a safe opening in window 10 yet allowing for relatively unhindered viewing out the window. The blocking elements are preferably manufactured from aluminum or tubular steel.

Figure 4:
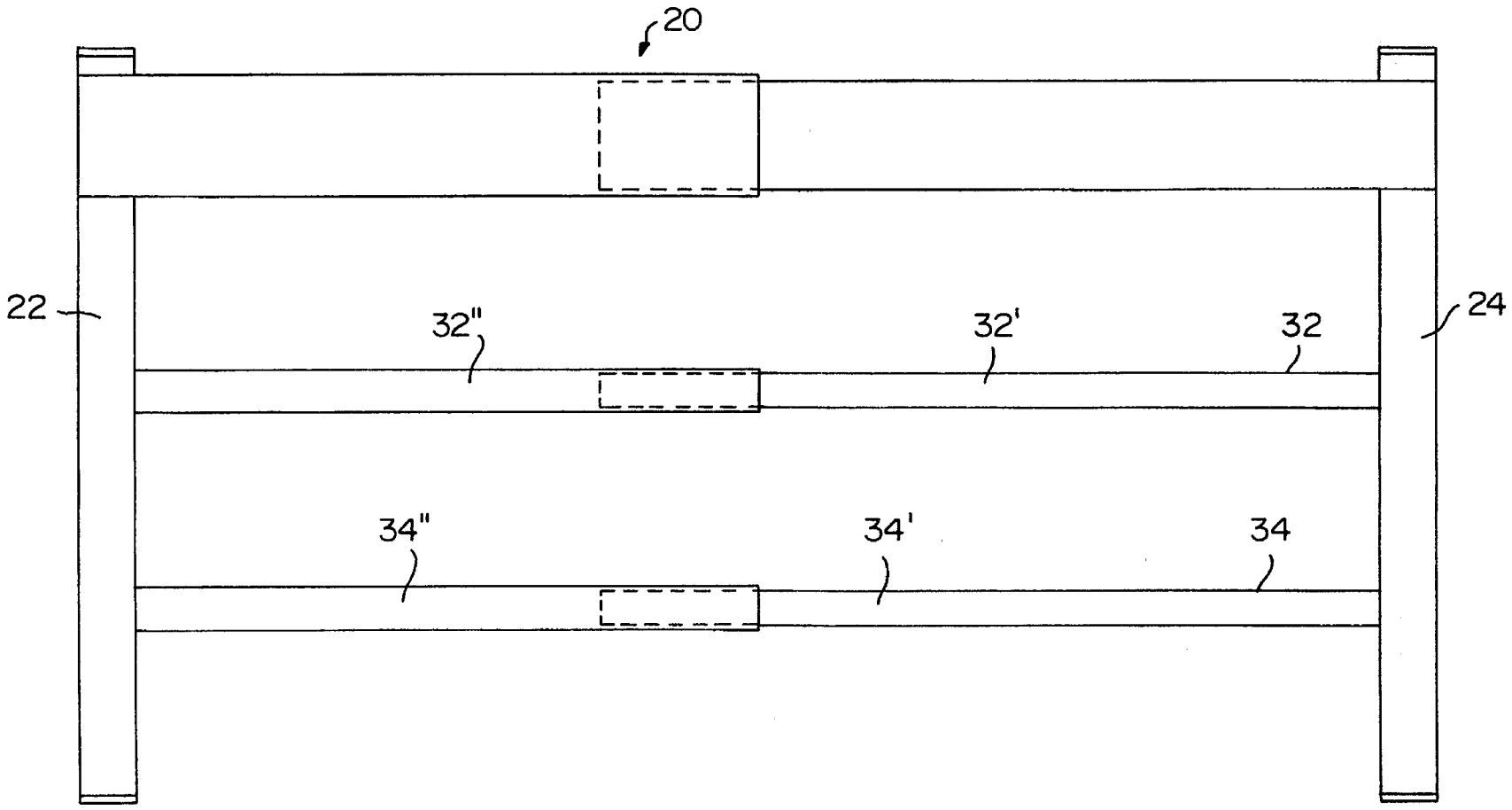
FIG. 4 shows a schematic elevation view of the telescoping cover and blocking elements as they travel in opposing vertical tracks.
Figure 5:
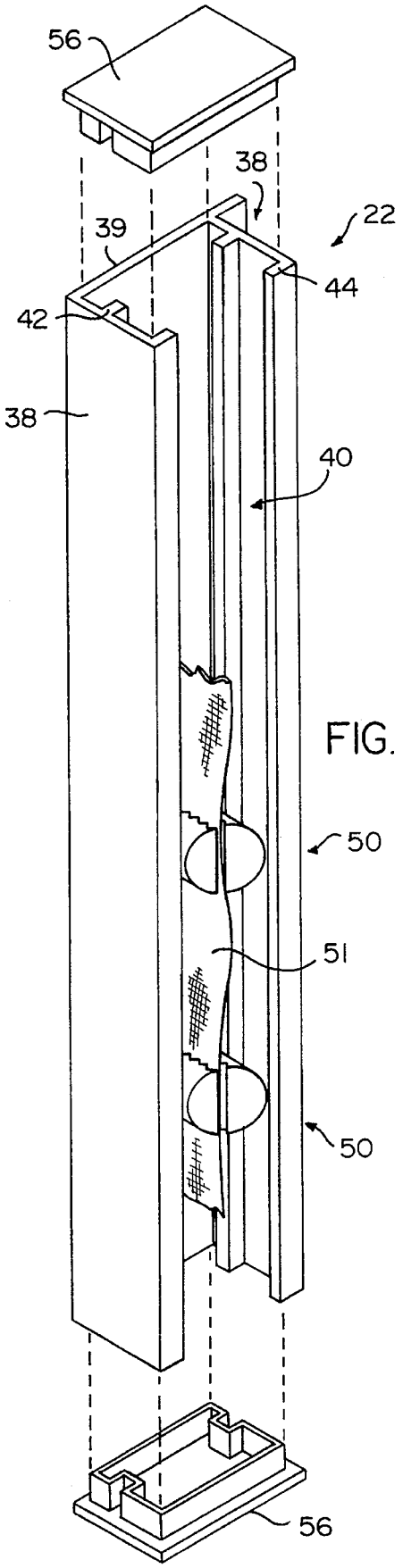
FIG. 5 is an exploded view of a vertical track of the window safety system of a preferred embodiment of the present invention.

FIG. 5 shows an exploded view of the track 22 which includes side panels 38, a rear panel 39, and an opening 40 running the length of the track 22. It is to be understood that the description with respect to track 22 shown in FIG. 4 is identical to that of track 24 mounted on an opposing side of the window. The track 22 is preferably fabricated from an aluminum based material in a conventional manner. The track may alternatively be manufactured from a hard plastic material. The track receives at least one guide element 50 having a connecting belt means 51 gripped between opposing jaws 54 of the guide element as more specifically described below. As depicted in FIGS. 5 and 6a, the track 22 further includes a first pair of opposing extensions 42 and a second pair of opposing extensions 44. The extensions protrude from side panels 38 toward a center longitudinal axis of the vertical track. The interaction between the first pair of extensions 42, the rear panel 39, and the side panels 38 form an inner track guide running along the length of the vertical track. The track preferably includes an attachment extension 46 having a fastener holes which receive a conventional fastener for mounting of the track on the inner frame 26 of the window 10 as more specifically described below with reference to FIGS. 11*a*, 11*b*, and 12.

FIG. 6*b* is a cross-sectional view of the vertical track 22, 24 with a guiding element 50 received within the track 22, 24. Specifically, the guiding element 50 comprises a plate portion 52 and a pair of extending jaws 54. The plate portion 52 is received between rear panel 39 of track 22, 24 and first extensions 42 which extend from side panels 38 and travels within the inner track guide. The jaws 54 of guide element 50 extend through an opening defined by the first extensions 42 toward extensions 44. This design is preferable in that it allows for easy and smooth travel of guiding elements in the vertical track 22, 24 as they travel from a lowered position to a raised position as more specifically described below. Furthermore, the tracks are easily manufactured from conventional extrusion processes thereby allowing manufacturing at am economical cost per unit. The track 22 also includes end caps 56 which may be secured to the opposing distal ends of the track 22.

FIGS. 7*a* through 7*c* depict the preferred design for blocking element 32, 34 as it interacts with guide elements 50. Specifically, guide element 50 comprises a plate portion 52 with two extending jaws 54 as noted above. The jaws 54 have teeth formed on an inner surface. The jaws 54 of the guide element 50 are dimensioned to provide a press fit when inserted into the distal end 58 of the tubular member 32, 34. During installation the connecting belt 51 is inserted through the jaws 54 and the jaws are forced into the distal end 58 of the tubular member 32, 34 which causes the jaws to bend inward thereby compressing the connecting belt 51 with a sufficient amount of force to permanently grab the belt 51 between the jaws 54. The connecting belt 51 extends through the jaws and through the opening 60 formed in the distal ends 58 of the tubular members 32, 34. FIG. 7*c* shows a plan view of the guide element 50 received in the tubular member 32, 34 as the element 50 rides along the track 22. The guide elements 50 are preferably manufactured from a plastic material to allow for smooth and easy travel within tracks 22, 24. Nylon is a preferable construction material for the guide elements 50.

FIG. 8*a* and 8*b* show the preferred embodiment of the safety system cover 20. Cover 20 is of the telescoping design which comprises an outer element 20" and an inner element 20' which is received within the outer element 20" for relative longitudinal movement. Specifically, element 20" is a cross-sectional L-shaped member having returns 21. Element 20' is a cross-sectional L-shaped member which is received within element 20" as shown in FIG. 8*a*. Elements 20" and 20' move relative to one another in the longitudinal direction as is conventional with telescoping members. The telescoping design is preferable in that it allows the cover to be used in a variety of window sizes. The cover components are preferably manufactured from extruded aluminum or tubular steel.

The distal ends of the telescoping cover 20 are shown in FIGS. 9*a* and 9*b*. In the preferred telescoping embodiment, the cover elements 20" and 20' are both the same in form at their distal end 62 and are shaped to be received within the vertical tracks 22, 24. Specifically, the opposing distal ends 62 of the cover 20 are formed as a cross-sectional L-shaped member having a short leg 64 and a long leg 66. The short leg is formed at its end to comprise a tab extension which comprises a T-shape extension having a base portion 68 and a distal portion 70. As depicted in FIG. 9*b*, the tab extension of the short leg 64 is inserted into the vertical track such that the distal portion 70 of the tab extension is received within the inner track guide formed by the tab extension 42, side panels 38, and rear panel 39. The base portion 68 of the tab extension is guided along longitudinal bearing surfaces 43 formed at the most inner portion of the first 42 and second 44 extensions. The distal end 62 of the cover elements are further guided in track 22, 24 by an extended portion 72 which travel along a side panel 38 of the vertical track 22, 24. Edges 74 of the short leg 64 bear against an outer surface 45 of the second extensions so as to provide further guidance of the cover as it travels in vertical tracks 22 and 24.

In a preferred embodiment the system cover 20 is mounted so as to interact with a lower rail of lower sash 16. Specifically, a rear edge 75 of the system cover 20 engages a portion of the lower rail of the lower sash such that when the lower sash is raised to open the window, the engaging portion of the lower rail contacts rear edge 75 of the cover 20. This in turn causes the cover 20 to lift with the ascending window sash. This embodiment is preferable because it does not require additional connecting components which connect the cover to the lower rail. However, an engagement element 112 may be necessary in certain types of windows as more specifically discussed with reference to FIGS. 13 through 15.

System cover 20 is a significant improvement over the prior art because it allows for complete housing of the blocking element 32, 34 when the lower sash 16 is in a lower closed position. In particular, short leg 64 forms an upper portion of a housing and long leg 66 extends downward forming a side portion of a housing to completely enclose blocking elements 32, 34 when the window sash 16 is in a lower closed position. This greatly increases the aesthetic appearance of the safety system over other prior art systems. It is noted, however, that connection to the lower window sash does not necessarily have to derive from cover element 20. An alternative element may be used such as a laterally extending element which connects to the lower window sash in a similar manner as the cover 20. If an additional element is provided which connects the system to the lower window sash 16 then cover 20 is not needed.

A connecting belt 51 is shown in a preferred embodiment in FIG. 10. The connecting belt 51 is preferably a belt formed from fabric or cloth having a loop end 76 and a body portion 78. As described above, the body portion 78 of belt 51 is received within jaws 54 of the guiding elements 50 and extend through opening 60 formed in the distal ends 58 of the blocking element 32, 34. The loop end 76 of the belt is secured around base portion 68 of the tab extension of the short leg 64 of the cover 20. Thus when assembled, the cover 20 is operably attached to the guiding elements 50 which are in turn secured to the blocking elements 32, 34. In the installed state, the track 22 receives the distal end of the cover 20 and at least one guide element 50. In the installed position, the distal end 62 of the cover 20 will always be the uppermost element received in the track. The connecting belt 51 is a significant improvement over prior art systems in that it allows for a flexible and resilient connection between system components and for controlled deployment of the blocking elements 32, 34.

Figure 11B:
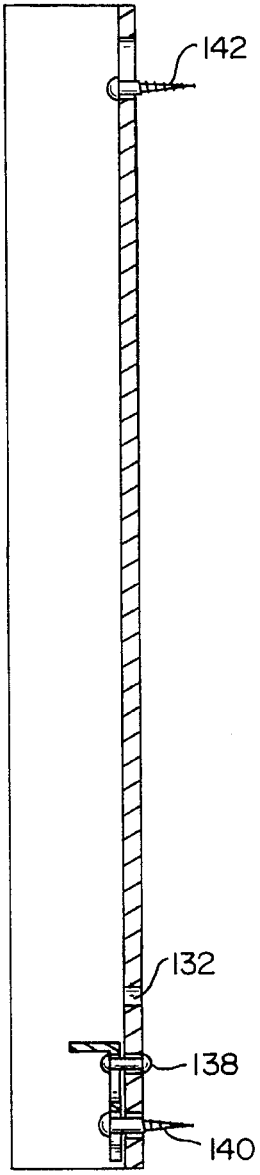

Referring to FIGS. 11*a* and 11*b* there is shown a preferred mounting design for the vertical tracks 22, 24. Specifically, vertical track 22, 24 is provided with an attachment extension 46. The attachment extension is provided with an upper mounting hole 130, lower fixed mounting hole 132, and a lower mounting groove 134. Further provided is a slide lock bracket 136 which is secured on the attachment extension 46 by a rivet 138. Installation of the vertical track is easily achieved with this preferred design. In particular, the vertical track is first secured on the inner portion of the window frame 26 by a screw 142 through mounting hole 130. The mounting screw 140 is then fastened through lower mounting groove 134. A slide bracket 136 includes a finger grasp portion 148, a rivet riding groove 146, and a fastener catch groove 144. Once the screw has been sufficiently tightened to secure the vertical track 22, 24 in place and leaving a shaft portion of screw 140 exposed for engagement, the system user grasp finger grip portion 148 and pushes downward so that the fastener catch groove 144 slides over the shaft of screw 140 thereby locking the vertical track 22, 24 in place. Significantly, system 12 removal may be accomplished quickly and easily by this preferred design. In particular, when it is desired to deactivate the system 12, such as in an emergency, the slide bracket 136 is raised and the vertical track is rotated about the upper screw 142. The safety system 12 is now deactivated and the lower sash 16 of the window 10 may now be raised without the placement of the blocking elements 32, 34 across the window opening. The track may then be easily removed by removing upper screw 142 to completely withdraw the safety system 12 from the window 10. The track may alternatively be permanently installed on the inner portion of window frame be inserting fastener 140 into lower fixed mounting hole 132.

As noted above, the window safety system 12 of the present invention can be easily installed in existing windows 10 without any significant modification to existing window structure. First, the vertical tracks 22 and 24 are installed in opposing sides 26 of the window frame 25. This is accomplished as set forth above. The belt 51 is next inserted through the jaws 54 of guide elements 50. The lower most guide element 50 followed by the upper most guide element 50 with inserted belt is then inserted through the opening at the distal end of the track 22, 24. The plate portion 52 of guide element 50 is inserted behind first track extensions 48. The distal ends 62 of the system cover 20 are then inserted into the distal end opening of the vertical tracks 22, 24 and loop portion 76 of the connecting belt 51 is secured around base portion 68 of the tab extension. In the preferred embodiment, cover 20 is of the telescoping type and must first be extended to the appropriate length to accommodate the window dimension. The distal ends 56 of the blocking element 32, 34 are then inserted into the opening 40 in the track 22, 24 and aligned with the guide elements 50. In the preferred embodiment, blocking elements 32, 34 are of the telescoping type and must first be extended to the appropriate length to accommodate the window dimension. The jaws 54 of the guide elements 50 are then forced into the open ends of the blocking element 32, 34 with the belt extending through the opening 60 in the ends 58 of the blocking elements 32, 34. The cap 56 is then placed over the distal end opening of the vertical track 22, 24. At this point system installation is complete and fully operational.

In operation, the safety system of the present invention is easily activated by an adult home occupant. The system is activated when the vertical tracks have been installed and a rear edge 75 of the cover element 20 engages a portion of a lower rail of a lower window sash. When a home occupant opens the window by grasping the lower window sash 16 and pulling upward, engaging portion of the lower rail of the lower window sash catches a rear edge of the cover 20 which causes the cover 20 to follow the lower rails ascending movement. The upward moving cover 20 within the tracks 22, 24 causes a first guide element 50 to lift upward due to its connection through connecting belt 51. In a safety system utilizing more than one blocking element, if the window is further raised then the tension on the belt 51 causes an additional guide element 50 to travel upward within track 22, 24 and so on. The movement of the guide elements 50 in an upward direction causes the corresponding attached blocking elements 32, 34 to lift upward and occupy the opening of the window.

When the window sash 16 is in a raised position the blocking elements occupy the space of the window opening thereby preventing a small child from passing through and accidently falling out the window. Furthermore, if a child is curious and grabs onto the blocking elements 32, 34 in an attempt to climb up onto the window sill, the window will merely close itself rendering the window safe. In this, constant parental guidance is not necessary if the safety system has been activated. If it is required to deactivate the window safety system 12 such as if emergency exit out the window is required or for routine window maintenance, the slide bracket 136 is raised and the vertical track is rotated about the upper screw 142. The window 10 may now be raised without the placement of the blocking elements 32, 34 across the window opening.

An alternative embodiment of the engagement of cover element 20 with the lower rail of lower window sash 16 is depicted in FIGS. 13 through 15. In FIG. 13 there is shown a system cover 20 having a substantially L-shaped cross-section as described above. Engagement elements 112 are secured to the underside of leg 106 of the cover 20 by using rivets 114. Preferably, the engagement elements 112 are dials which have a rail contacting portion 116 and a finger grasping portion 118 as shown in FIGS. 14a and 14b. The dials 112 are riveted to the underside of leg 106 with the rivet extending through holes 120 located in leg 106. The dials may be rotated between a first position where the contacting portion 116 extends beyond the edge 122 of the leg 106 and a second position where the finger grasp portion 118 runs along the edge 122 of leg 106. The dial 112 in its first and second positions is shown in solid and dashed lines respectively in FIG. 13.

The interaction of the engagement element 112 and a lower rail 124 of a lower window sash 16 is shown in FIG. 15. There is shown an element 126 which is an L-shaped member 126 secured to the lower rail 82 by conventional means such as tacks or screws. A portion of the element 126 extends from the surface of the rail 124 toward the cover leg 106. Preferably, there are two connecting elements 126 which interact with corresponding dial elements 112. The dial 112 is shown in its first position extending beyond the edge 122. In this position, when the lower window sash is raised, the element 126 contacts the contacting portion 116 of the dial 112 which is in its first position. This in turn causes the cover 102 to be raised along with the lower sash 16. This use of the dial elements 112 is a preferred means of engaging the lower rail of the lower sash 16 in certain window configurations. In particular, if the lower rail is formed in a manner such that engagement with a rear edge 75 of cover 20 is not possible, then the dial elements should be secured to the cover 20 for use in the safety system 12.

FIG. 16 shows an alternative embodiment of vertical track 22, 24 and guide elements 50. Vertical track 80 of the alternative embodiment has a rectangular cross-section for receiving guide bushing 82 and guide elements 84. The guide bushing 82 is more specifically shown in FIGS. 17*a* through 17*c*. The bushing element 82 has a slit bore opening 86 which receives a portion of cover 20 as more fully set forth below. The bushing element 82 also contains at least one groove 88 extending along the sides of the bushing element 82. The groove 88 is of sufficient depth to receive a transverse portion of belt 90. Bushing element 88 is preferably manufactured from a plastic material to allow for smooth and easy travel within the tracks 22, 24. A preferable construction material is nylon.

As shown in FIGS. 16 and 19*a* through 19*c*, the guide elements 92 cooperate with the distal ends of the tubular member 32,34. More specifically, guide element 92 has a central bore 94 and side grooves 96. In this embodiment, each of the tubular blocking elements is inserted at both of its distal ends directly into the central bore 94 of the guide elements 92. The tubular member of this embodiment will have a circular cross-sectional end without longitudinal openings as in the embodiment set forth above. The blocking elements may be of the telescoping type or single tubular member. Of course, alternative shaped blocking elements may be used with correspondingly shaped receiving bores in the guide elements 92. The belt in this embodiment is secured to the guide elements 92 in the same manner as the belt is secured to the guide bushing 82. That is, the belt 90 is placed in one of the side grooves 88, 96 and a plate 98 is place over the belt in the groove 88, 96 and at least one staple 100 is inserted through the plate 98 and belt 90 and into the guide element 92 or bushing 82. Of course alternative securing means are considered to be within the scope of the invention.

FIG. 18 shows safety system cover 102 of the alternative embodiment. Cover 102 has opposing distal ends 104 which interact with bushing elements 82. Specifically, cover 102 is an L-shaped cross-sectional member which has a short leg 106 and a long leg 108. The short leg 106 has a slot 108 which forms an extension arm 110. Extension arm 110 is dimensioned to be forced fitted and received in slot 86 of the bushing element 82. In this, leg 106 extends horizontally from one bushing element 82 to the opposing bushing element 82 and the long leg 108 extends vertically downward a sufficient distance so as to completely house the blocking elements 32, 34 when the window sash 16 is in a lowered position. Holes 120 are formed in cover 102 to receive the rivet 114 and secure the dial element 112 thereon. However, if the window 10 does not require the use of a separate engagement means, the dials will not be installed and a rear edge of the cover element will serve to contact the lower rail of the lower window sash 16 as described above. Moreover, if the safety system does not utilize a cover, an alternative element may be inserted into slot 86 of the bushing element 82 to provide connection to the lower window sash.

SUMMARY OF MAJOR ADVANTAGES OF THE INVENTION

After reading and understanding the foregoing detailed description of an inventive window safety system in accordance with preferred embodiments of the invention, it will be appreciated that several distinct advantages of the subject window safety system are obtained.

Without attempting to set forth all of the desirable features of the instant window safety system, at least some of the major advantages include providing a window safety system 12 which may easily installed in existing windows 10 without any significant modifications to the existing structure. The window safety system includes a pair of opposed vertical tracks 22 and 24 which are installed on opposing sides of the window frame 26. A safety cover 20 is formed at its opposed distal ends to operably interact with vertical tracks 22 and 24. At least one blocking element 32, 34 is connected at opposing ends to guide elements 50. Preferably, blocking elements 32, 34 are telescopic tubular elements having ends 58 with openings 60. A connecting means 51 is operably attached to each of the guide elements 50 and to the distal end 62 of the cover which is received with the vertical tracks 22, 24. Guide elements 50 comprise a plate 52 with extending jaws 54 which receive and clamp belt 51. The blocking elements 32, 34 of the safety system 12 of the present invention occupy the opening of the window 10 when the lower sash 16 of the window 10 is raised to open the window 10. In this, the safety system is automatically set in place whether an adult occupant is present or not. Moreover, when the window sash 16 is in a lower closed position, the system cover 20 completely houses the blocking elements 32, 34. This design provides for an improved window safety system which, unlike prior art systems, does not detract from the aesthetic appearance of the window 10.

Additionally, if a small child grasp the blocking elements 32, 34 in an attempt to climb up onto the window, the lower window sash 16 will simply close thereby rendering the window safe from further climbing by the small child.

A rear edge of the system cover 20 engages a lower rail of a lower window sash such that sash movement is followed by movement of the cover 20. The system 12 may easily be deactivated and/or removed from the window 10 by raising a slide lock bracket 136 which is secured on an attachment extension 46 of the vertical tracks 22, 24 and rotating the tracks about an upper screw 142. Alternatively, at least one dial element 72 is secured to the underside of cover 20 and is operable between a first and second position. The dial element 72 in its first position operably engages a lower rail 82 of lower sash 16 such that when lower sash 16 is raised in order to open the window, the bar cover 20 is caused to lift in similar fashion. The lifting of the bar cover 20 in turn causes the blocking elements 32, 34 to occupy the window opening. The dial element 72 allows for easy and simple system activation and deactivation by an adult occupant. Such simplicity is essential especially in case of an emergency, such as a fire, where fast exit is needed.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A window safety system for use in a window having a frame, upper and lower sash, anti a sill, said window safety system being operable to prevent a child, mentally impaired adult, pet or the like from accidentally falling through an open window, said window safety system comprising:

a first vertical track for securing to an inner portion and on one side of the window frame and for extending upwardly from the window sill;

a second vertical track for securing to an inner portion and on an opposing side of the window frame and comprising a substantial mirror image of said first vertical track and for extending upwardly from said window sill;

at least a pair of guide elements wherein at least one of said at least pair of guide elements is operably received to translate along said first vertical track and at least the other of said at least pair of guide elements is operably received to translate along said second vertical track, said, guide elements having at least a portion operable to be guided by said vertical track;

at least one elongated means for blocking egress through an open window having first and second ends operably engaged with said at least a pair of guide elements such that said first end of said elongate means for blocking is operably connected to said guide element received to translate along said first vertical track and said second end of said elongate means for blocking is operably connected to said guide element received to translate along said second vertical track;

an elongate cover having first and second ends formed to be operably received to translate along said first and second vertical tracks such that said first end of said elongate cover is operably received to translate along said first vertical track and said second end of said elongate cover is operably received to translate along said second vertical track;

first and second connecting means positioned within said first and second vertical tracks such that said first connecting means operably connects said at least one of said at least pair of guide elements and said first end of said elongate cover received to translate along said first vertical track and said second connecting means operably connects said at least the other of said at least a pair of guide elements and said second end of said elongate cover received to translate along said second vertical track;

whereby said elongate cover is constructed for engagement with the lower window sash such that when said lower window sash in moved from a closed window position to an open window position, said elongate cover and said at least a pair of guide elements are caused to travel upward with said lower window sash which in turn causes said at least one elongate means for blocking to occupy a position laterally across the opening in the window to prevent egress of a child or the like.

2. A window safety system as defined in claim 1 wherein:

said first and second vertical tracks are substantially rectangular in cross-section and are defined by a rear panel, two side panels and an elongate opening in the side of the track opposed to said rear panel.

3. A window safety system as defined in claim 2 wherein:

said first and second vertical tracks are further defined by a pair of first and second extensions which extend from said side panels of said vertical track and have a bearing surface at their distal ends such that an inner guide track is defined by the interaction of the rear panel, side panels, and said first pair of extensions.

4. A window safety system as defined in claim 3 wherein:

said second pair of extensions of the first and second vertical tracks extend from the most distal end of the side panels and define an outer bearing surface.

5. A window safety system as defined in claim 3 wherein:

at least the first and second ends of said elongate cover are L-shaped in cross-section with a short leg and a long leg and said short leg is formed to be operably received within said vertical track.

6. A window safety system as defined in claim 5 wherein: the short leg of the first and second ends of said elongate cover is formed as a T-shaped extension having a base portion and a distal portion such that said distal portion is received for translation within said inner guide track and said base portion extends through said opening formed in said vertical track such that the sides of said base portion interact with said bearing surfaces on the distal ends of said first and second extensions.

7. A window safety system as defined in claim 1 wherein:

said elongate cover comprises a telescopic unit having a first cover element which operably receives a second cover element for relative longitudinal translation.

8. A window safety system as defined in claim 1 wherein:

the first and second vertical tracks are further defined by an attachment extensions having an upper mounting hole and a lower mounting hole for receiving a fastener for securing the track to an inner portion of the window frame.

9. A window safety system as defined in claim 8 wherein:

the first and second vertical tracks are further defined by a lower mounting groove for receiving a fastener for securing the track to an inner portion of the window frame.

10. A window safety system as defined in claim 9 wherein:

the first and second vertical tracks are further defined by a slide bracket which is operable between a first raised position and a second lowered position such that when said slide bracket is in said second lowered position, said slide bracket engages a fastener received through said lower mounting groove such that the respective first and second vertical tracks are secured on the respective inner portions of the window frame.

11. A window safety system as defined in claim 1 wherein:

a rear edge of the cover operably engages the lower rail of the lower window sash of the window such that when said lower window sash is raised said cover follows the movement of said lower window sash.

12. A window safety system as defined in claim 1 wherein:

engagement means are provided which are operably attached to said elongate cover and operable between a first position and a second position such that when said engagement means is in said first position it operably engages a lower sash of said window and when said engagement means is in said second position said lower sash is free from engagement of said connecting means

13. A window safety system as defined in claim 12 further comprising:

an engagement element for securing to a lower rail of a lower window sash to operably engage said engagement means when said engagement means is in said first position.

14. A window safety system as defined in claim 1 wherein:

said elongate blocking element comprises a tubular member.

15. A window safety system as defined in claim 14 wherein: said elongate blocking element is further defined by cut away portions at its first and second ends.

16. A window safety system as defined in claim 1 wherein:

said elongate blocking element comprises a telescopic unit having a first member which receives a second member for relative longitudinal movement.

17. A window safety system as defined in claim 15 wherein:

said at least pair of guide elements comprise a clamp having a rear plate with two extending jaws which receive said connecting means therebetween whereby said jaws are sized to press fit within said ends of said tubular member such that said connecting means is clamped between said jaws and extends through said cut away portions at said first and second ends of said tubular member.

18. A window safety system as defined in claim 1 wherein:

said means for guiding are formed from nylon to allow for easy and smooth travel within said vertical tracks.

19. A window safety system as defined in claim 1 wherein:

said connecting means is a flexible belt having a body portion and a distal loop portion which is secured around a respective portion of the first and second ends of the cover received within said first and second vertical tracks.

20. A window safety system as defined in claim 1 wherein:

there are two pairs of guiding elements which are operably connected to respective first and second blocking elements.

21. A window safety system for use in a window having a frame, upper and lower sash, and a sill, said window safety system being operable to prevent a child, mentally impaired adult, pet or the like from accidentally falling through an open window, said window safety system comprising:

a first vertical track for securing to an inner portion and on one side of the window frame and for extending upwardly from the window sill;

a second vertical track for securing to an inner portion and on an opposing side of the window frame and comprising a substantial mirror image of said first vertical track and for extending upwardly from said window sill;

at least a pair of means for guiding wherein at least one of said at least pair of means for guiding is operably received to translate along said first vertical track and at least the other of said at least pair of means for guiding is operably received to translate along said second vertical track;

at least one elongated means for blocking egress through an open window having first and second ends operably engaged with said at least pair of means for guiding such that said first end of said elongate means for blocking is operably connected to said means for guiding received to translate along said first vertical track and said second end of said elongate means for blocking is operably connected to said means for guiding received to translate along said second vertical track;

a pair of guide bushing means wherein one of said guide bushing means is operably received to translate along said first vertical track and the other of said pair of guide bushing means is operably received to translate along said second vertical track, said pair of guide bushing means received to translate along said first and second tracks such that each of said guide bushing means travels along its corresponding vertical track above said at least pair of means for guiding;

first and second connecting means positioned within said first and second vertical tracks respectively such that said first connecting means operably connects said at least one of said at least pair of means for guiding and said guide bushing means of said first vertical track and said second connecting means operably connects said at least the other of said at least pair of means for guiding and said guide bushing means within said second vertical track;

an elongate cover having first and second ends operably engaged with said pair of guide bushing means such that said first end of said elongate cover is operably connected with said guide bushing means received to translate along said first vertical track and said second end of said elongate cover is operably connected to said guide bushing received to translate along said second vertical track;

whereby said elongate cover is constructed for engagement with the lower window sash such that when said lower window sash in moved from a closed window

22. A window safety system as defined in claim 21 wherein:

engagement means are provided which are operably attached to said elongate cover and operable between a first position and a second position such that when said engagement means is in said first position it operably engages a lower sash of said window and when said engagement means is in said second position said lower sash is free from engagement of said connecting means.

23. A window safety system as defined in claim 21 wherein: said first and second vertical tracks have a rectangular cross-section with an elongate opening in one side of said vertical track.

24. A window safety system as defined in claim 23 wherein:

said pair of guide bushings means are substantially rectangular in cross-section and correspond in dimension to the inner rectangular dimension of the first and second vertical tracks, said guide bushings means having a receiving bore exposed through said opening of said track when said guide bushings are received within respective first and second tracks.

25. A window safety system as defined in claim 23 wherein:

the first and second ends of said elongate cover are shaped such that the ends are received through said opening in said track and into said receiving bore of said guide bushings means.

26. A window safety system as defined in claim 21 wherein:

said elongate blocking element comprises a tubular member.

27. A window safety system as defined in claim 26 wherein:

said at least pair of means for guiding are substantially rectangular in cross-section and correspond in dimension to the inner rectangular dimension of the first and second vertical tracks and have a receiving bore dimensioned to receive a distal end of said tubular member.

28. A window safety system as defined in claim 27 wherein:

said each of said at least pair of means for guiding has a groove in at least one of its sides which is dimensioned to receive the connecting means.

29. A window safety system as defined in claim 28 wherein:

said connecting means is secured in said groove of each of said means for guiding by a plate means inserted into said groove and a staple fastening said plate means and said connecting means to said means for guiding in said groove.

30. A window safety system as defined in claim 21 wherein:

said elongate cover is L-shaped in cross-section whereby the short leg of said L-shaped cover engages each of said pair of guide bushings means at its first and second ends and the long leg of said L-shaped cover extends downward such that when said lower window sash is in a lower closed position said at least one blocking element is completely housed by said cover.

31. A window safety system as defined in claim 22 wherein:

said engagement means comprise at least one dial element secured to said cover such that when said dial element is in said first position a portion of said dial element engages a lower rail of said lower window sash and when said dial element is in said second position said portion of said dial element is disengaged from said lower rail of said lower window sash. position to an open window position, said elongate cover and said pair of bushing means and said at least one pair of means for guiding are caused to travel upward with said lower window sash which in turn causes said at least one elongate means for blocking to occupy a position laterally across the opening in the window to prevent egress of a child or the like.

32. A window safety system as defined in claim 31 further comprising:

a contacting element which interacts with said portion of said dial element when said dial element is in said first position such that when a lower sash of a window is raised and said dial element is in said first position, said contacting element engages said portion of said dial element to cause said cover to lift with said lower sash thereby activating the safety system.

33. A window safety system for use in a window having a frame, upper and lower sash, and a sill, said window safety system being operable to prevent a child, mentally impaired adult, pet or the like from accidentally falling through an open window, said window safety system comprising:

a first vertical track for securing to an inner portion and on one side of the window frame and for extending upwardly from the window sill;

a second vertical track for securing to an inner portion and on an opposing side of the window frame and comprising a substantial mirror image of said first vertical track and for extending upwardly from said window sill;

at least a pair of guide elements wherein at least one of said at least a pair of guide elements is operably received to translate within said first vertical track and at least the other of said at least a pair of guide elements is operably received to translate within said second vertical track, said guide elements having at least a portion operable to be guided by said vertical track;

at least one elongated means for blocking egress through the open window having first and second ends operably engaged with said at least a pair of guide elements such that said first end of said elongate means for blocking is operably connected to said guide element received within said first vertical track and said second end of said elongate means for blocking is operably connected to said guide element received within said second vertical track;

a cover having first and second ends formed to be operably received to translate along said first and second vertical tracks such that said first end of said cover is operably received to translate along said first vertical track and said second end of said elongate cover is operably received to translate along said second vertical track, said cover constructed to engage a lower window sash when the safety system is installed in a window;

first and second connecting means positioned such that said first connecting means operably connects said at least one of said at least pair of guide elements and said elongate cover received to translate along said first vertical track and said second connecting means operably connects said at least the other of said at least pair of guide elements and said elongate cover received to translate along said second vertical track;

means for permitting the disengagement of the cover from a lower window sash when said safety system is installed in a window; whereby when said lower window sash in moved from a closed window position to an open window position, said cover and said at least a pair of guide elements are caused to travel upward with said lower window sash which in turn causes said at least one elongate means for blocking to occupy a position laterally across the opening in the window to prevent egress of a child or the like.

* * * * *